US005435357A

United States Patent [19]

Woods et al.

[11] Patent Number: 5,435,357

[45] Date of Patent: Jul. 25, 1995

[54] VAPOR RECOVERY FUEL NOZZLE SYSTEMS PROVIDING AN IMPROVED SLURPEE FUNCTION

[75] Inventors: Robert L. Woods; Donald W. Murray, both of Arlington, Tex.

[73] Assignee: Dover Corporation, New York, N.Y.

[21] Appl. No.: 301,060

[22] Filed: Sep. 6, 1994

[51] Int. Cl.[6] ..... B65B 31/00

[52] U.S. Cl. ..... 141/59; 141/46; 141/206

[58] Field of Search ..... 141/59, 44, 45, 46, 141/206–229

[56] References Cited

U.S. PATENT DOCUMENTS 5,197,523 3/1993 Fink, Jr. et al. ..... 141/46

5,273,087 12/1993 Koch et al. ..... 141/206

*Primary Examiner*—Robert M. Fetsuga

*Assistant Examiner*—Timothy L. Maust

*Attorney, Agent, or Firm*—Kinney & Schenk

[57] ABSTRACT

A vapor recovery, fuel dispensing nozzle possessing the capability of providing a slurpee function, i.e., removing liquid fuel from the vapor return passage of a hose that connects the nozzle to a fuel dispenser. Removal of the liquid fuel is achieved by a suction force derived from a venturi at the main control valve of the nozzle.

11 Claims, 4 Drawing Sheets

VAPOR RECOVERY FUEL NOZZLE SYSTEMS PROVIDING AN IMPROVED SLURPEE FUNCTION

The present invention relates to improvements in fuel dispensing nozzle systems which include means for recovering fuel vapors displaced from a vehicle fuel tank to thereby minimize atmospheric pollution. Such systems include hose means that provide a vapor return passage, for the recovered vapors, from the nozzle to a dispenser pedestal. Further conduit means direct the recovered vapors from the pedestal back to the storage tank, from which the fuel has been drawn to fall the fuel tank, or other point of disposal.

The problem addressed by the present invention is found in the fact that liquid fuel can collect in the vapor return passage of the hose that connects the nozzle to the dispenser. When a nozzle is inserted into the fall pipe of a vehicle fuel tank, this hose is normally draped to form a loop. Fuel vapors can condense to a liquid and collect in this loop. Also, liquid fuel can be entrained into the vapor flowing through the hose, vapor return passage and collect in the hose loop. Either or both causes can result in the collection of sufficient liquid in the hose passage loop to block flow of vapor therethrough. When such blockage occurs, the vapor recovery function is defeated.

It is to be recognized that there are two basic types of vapor recovery systems.

One type, known as a balance system, involves the provision of means (usually a bellows) that define an annular vapor flow path around the fuel dispensing nozzle spout. This vapor flow path, at the spout, is sealed with respect to the fuel tank inlet. As fuel is dispensed into the fuel tank, vapor is displaced and a pressure balance is achieved, as the displaced vapors flow through the nozzle, the hose connection and conduit means, back to the storage tank.

The other basic type of vapor recovery system is known as a vacuum assist vapor recovery system. In this type of system the use of a bellows is usually eliminated and it is not necessary to effect a sealed connection between the nozzle and the fuel tank, fill pipe. Instead, a vacuum pump provides a negative pressure in the vapor return passageways/conduits. The vacuum return system has an entry, at the distal end of the nozzle spout, into which vapors are drawn to prevent their escape into the atmosphere.

The problems of liquid fuel blocking the hose vapor passage have been found primarily, but not exclusively, in the vacuum assist, vapor recovery, systems.

Various means (discussed below) have be proposed for suctioning liquid fuel from the loop, or low point, in a vapor return hose means to prevent the return flow of vapor being interrupted. This suctioning action has become known as a "slurpee" function. The present invention is more particularly directed to improvements in providing this slurpee function.

The first known teaching of the slurpee function is found in U.S. Pat. No. 4,566,504, which provides an aspirator disposed in a pedestal. A suction tube extends from the aspirator to the low point of the hose, vapor return passage. Flow of fuel through the aspirator venturi creates a suction that draws liquid fuel from the hose to prevent its collection in the hose and blockage of the vapor return passage.

U.S. Pat. No. 4,687,033 teaches the provision of a coaxial hose in which a central tube provides a fuel flow passage and a concentric tube defines, in combination with the central robe, an annular, vapor return passage. In this teaching a venturi aspirator is disposed so as to define the fuel flow path through an end portion of the hose. Again a tube extends from the aspirator to the low point in the vapor passage of the hose. Liquid is thus continuously drawn from the low point of the vapor passage to the fuel being delivered, through the hose, to the nozzle.

U.S. Pat. No. 4,749,009 teaches a modification of the '033 patent in which the venturi aspirator is disposed, in the fuel tube of the coaxial hose, at the low point of the hose. This placement of the aspirator enables elimination of the suction robe of the first mentioned patents.

At this point it will be noted that fuel dispensing nozzles conventionally and universally (at least in the retail sale of fuel) include means for automatically shutting off fuel flow to prevent the overfilling of fuel tank. This shut-off function is attained through the provision of a venturi that generates a negative pressure in a vacuum system. In one fashion or another, when the fuel in a tank being filled reaches an upper limit, this vacuum system is actuated to automatically close the fuel control valve of the nozzle and thereby shut off fuel flow before an overfill occurs.

U.S. Pat. Nos. 5,035,271, 5,197,523 and 5,199,471 teach the use of this preexisting, nozzle venturi as the source of a suction to provide the slurpee function. These patents further teach that the slurpee function is provided in a nozzle construction wherein the venturi is downstream of the main flow control valve for the nozzle, The venturi constructions in the last referenced patents further include a spring loaded check valve that is closed when the main flow control valve is closed to shut off fuel flow. In accordance with these teachings, a suction passage, internal of the nozzle, extends from the throat of the shut off venturi to the end of the nozzle to which the coaxial hose is attached. A suction tube is mounted in the annular fuel passage of the coaxial hose and extends to its lower end. This tube is connected to the vacuum passage of the nozzle, when the coaxial hose is attached to the nozzle. With this arrangement, when fuel is being dispensed by the nozzle, fuel flow through the shut-off centuri will also create a vacuum in the slurpee conduit system, to suction liquid fuel from the low point of the hose ,Mad return the suctioned fuel back into the fuel being discharged from the nozzle.

There is an obvious advantage in having a single venturi providing a suction for both the shut off mad slurpee functions. This is to point out that the venturi aspirators that had been provided, separately and upstream from the nozzle, involve an additional energy loss that can adversely affect the flow rate at which fuel can be delivered. There are also other advantages in providing the slurpee aspirator in the nozzle, including the fact that, in most instances, it is less expensive to do so.

Notwithstanding, the apparent advantages of a dual function venturi (shut off/slurpee), serious drawbacks have been found in "cross talk" between the two functions. This is to say that when liquid fuel is being drawn from the vapor return hose, there can be a false actuation of the shut off function. Alternatively there can be a delay in actuation of the shut off function to the end that a tank can be overfilled, and fuel spill onto the ground.

Accordingly, one object of the present invention is to provide a nozzle providing both an automatic shut off function and a slurpee function, wherein each function is essentially unaffected by operation of the other function.

A further object of the invention is to attain the above ends in a maimer involving a minimum of energy losses in providing the slurpee function.

The foregoing ends maybe attained, in accordance with the broader aspects of the invention, by a fuel dispensing nozzle comprising a fuel delivery passage extending from a hand grip portion to a spout from which fuel is discharged into a container. A main valve controls the flow of fuel through the delivery passage. Automatic shut-off means, responsive to a vacuum generated by flow of fuel through a shut-off venturi downstream of the main valve, cause the main valve to close when the level of fuel in the container rises to a given level. Further, a vapor return passage extends from the spout to the hand grip portion. The fuel dispensing nozzle is adapted for connection to hose means including fuel and vapor passages.

In order to provide a slurpee function of evacuating liquid fuel from the vapor passage of the hose means, the nozzle also includes a slurpee, vacuum passage adapted for connection to a tube that extends from the nozzle, to an intermediate, low point along the length of the vapor passage of the hose means.

The ends of the invention are more specifically achieved by a slurpee, venturi passage, which is upstream and independent of the shut off venturi, preferably being located at the main valve. This venturi passage is then connected to the slurpee, vacuum passage, whereby liquid will be evacuated from the vapor passage of the hose means and returned to the fuel delivery passage of the nozzle by way of the slurpee, venturi passage at the main valve.

In accordance with more specific aspects of the invention, the main valve may comprise an annular valve seat through which the fuel delivery, passage passes and a sealing disc in opposed relation to the valve seat. A spring urges the disc towards sealing engagement with the valve seat. Further, a valve stem is displaceable to move the sealing disc to an open position in spaced relation with valve seat.

A venturi plug, which is centrally disposed of the portion of the fuel passage immediately downstream of the valve seat, de-fines the inner bounds of the slurpee venturi passage.

The nozzle may comprise a nozzle body, with the portion of the fuel flow passage through and immediately downstream of the valve seat being vertically disposed. The valve stem can extend through a lower portion of the nozzle body and be generally aligned with the vertical fuel flow passage downstream of the valve seat.

The ends of the invention ,are further attained by the lower portion of the venturi plug being positioned by the valve stem. Additionally means are provided for guiding the upper end of the venturi plug to thereby maintain the venturi plug in a stable, concentric relation with the slurpee venturi passage.

Also, an upper opening in the nozzle body may be provided above the valve seat mad aligned with the lower opening in the nozzle body. A spring cap is threaded in the upper body opening to maintain spring in a position urging the sealing disc toward sealing engagement with the valve seat.

A preferred approach to stably positioning the plug is achieved by the valve stem extending through the venturi plug to position both its upper and lower ends. The upper end of the valve stem is then slidingly guided by means extending downwardly from the spring cap.

An alternate arrangement for stably positioning the plug can be achieved through a seal holder for the sealing disc of the main valve. The seal holder is positioned in fixed, centralized relation to the upper end of the plug and has an upstanding skirt, which is slidably received in and guided by a bore in the spring cap.

The ends of the invention may also be attained through the use of a tubular seat member disposed coaxially of a common axis for the valve stem and spring cap. The tubular seat member defines the outer bounds of the slurpee venturi passage, with the valve seat being formed on its upper end.

Additional advantages are found in the tubular seat member and the plug cooperating to define a venturi throat at the upper end of the tubular member. A vacuum chamber surrounds the tubular member adjacent its upper end, with the slurpee vacuum passage connecting with this vacuum chamber. The vacuum chamber is in fluid communication with the venturi throat to enable the slurpee function.

A further feature is found in providing a circumferential groove, at the venturi throat, immediately below the upper end of the tubular seat member. The upper side of said circumferential groove is defined by a lip that projects inwardly from the inner diameter of the tubular member.

The ends of the invention may also be attained by a vapor cap defining a portion of the vapor return passage, detachably mounted on the nozzle body, and in overlying relation to the spring cap, all in a nozzle where the slurpee function is provided by a venturi at the main valve.

Further features of the invention are found in a nozzle that includes a nozzle body, wherein the fuel flow passage through and immediately downstream of the valve seat is generally vertically disposed. The valve stem extends through a lower portion of the nozzle body and is generally aligned with the fuel flow passage downstream of the valve seat.

The venturi passage is characterized by a venturi ring mounted in the fuel flow passage, downstream of the valve seat, defining, in combination with the plug, the venturi throat.

The above and other objects and features of the invention will be apparent from a reading of the following description of a preferred embodiment of the invention, with reference to the accompanying drawings, mad the novelty thereof pointed out in the appended claims.

Figure 1:
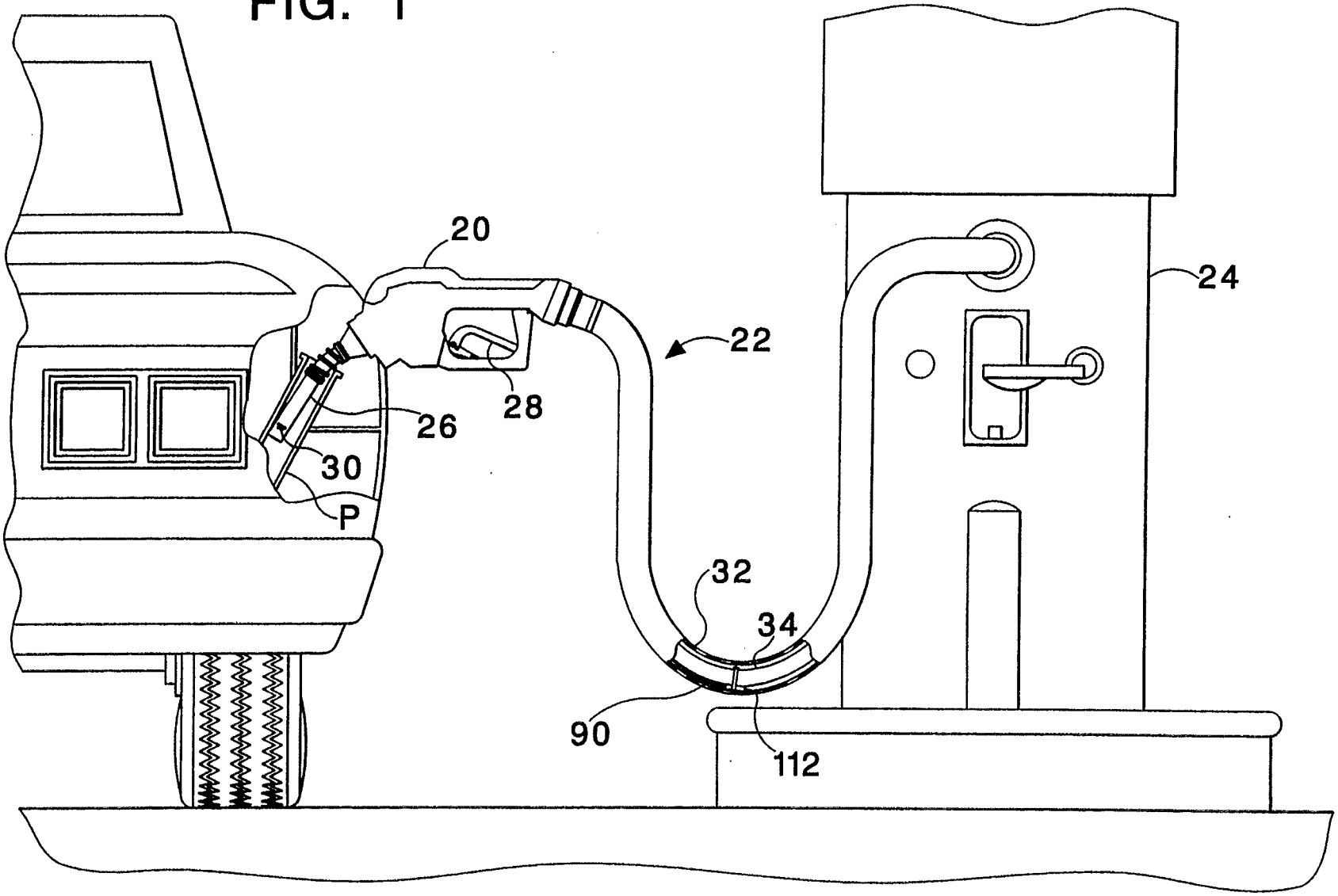
FIG. 1 is an elevation illustrating the use of a fuel dispensing nozzle having the slurpee function improvements of the present invention.

FIG. 1 illustrates the principal environment in which the present invention is practiced. Thus, in conventional fashion, a fuel dispensing nozzle 20 is connected, by a coaxial hose 22, to a fuel dispenser 24. The nozzle has a spout 26 that is adapted to be inserted into the fill pipe P of a vehicle fuel tank. Discharge of fuel into the vehicle tank is manually controlled be a lever 28.

The nozzle 20 and hose 22 are components of a vapor recovery., fuel delivery, system, which is, per se, well known. This is to point out that the nozzle 20 and hose 22 have fuel and vapor return passages that extend from the nozzle spout to the dispenser 24. The hose fuel passage connects with a source of pressurized fuel in the dispenser and then with a fuel passage in the nozzle 20, for discharge of the fuel from the spout 26. The vapor return passage has an entry 30, which extends from the distal end of the spout, through the nozzle, to the hose 22. The hose 22 is of the coaxial type comprising an outer hose 32 and a smaller diameter inner hose 34, which combine to define an annular, vapor return, flow path to the dispenser 24. At the dispenser 24, a connection is made with conduit means that are connected to a vacuum source and also return the recovered vapors to the fuel storage tag, or other place of disposal.

The nozzle 20 (FIG. 2) is conventional in that it comprises a nozzle body 36 having a hand grip portion 38, connected to the coaxial hose 22, with the inner hose 34 being in fluid communication with a nozzle body flow passage 40. A main flow control valve 42 controls flow of fuel through the nozzle. Downstream of the valve 42, the fuel flow passage includes a venturi 44, which is defined by a check valve 46. The valve 46 is resiliently urged to a closed position by a spring 48. After fuel flows past the venturi 44, it enters a central tube 50, in the spout 26, for discharge from the distal end thereof.

The main control valve 42 is operated in a conventional fashion by manually raising the lever 28. The lever 28 is pivotally mounted at the lower end of a stem 52, which is latched in its illustrated, operating position by a trip mechanism 54. The trip mechanism includes a diaphragm 56 which defines the lower portion of a chamber 58. The chamber 58 is in fluid communication with the venturi 44. The chamber 58, through passages in fluid communication therewith, is vented to the atmosphere by way of a tube (not shown) that extends through the spout 26 and opens at the distal end of the spout.

When fuel is being discharged from the nozzle, a negative pressure is created by the flow of fuel through the shut off venturi 44. Normally, this negative pressure is of a minimal value due to the vent tube that extends through the spout to atmospheric pressure. When the level of fuel in a fill pipe reaches the level of the spout, the entrance to this vent tube is blocked. There will then be an immediate increase to the negative pressure in the chamber 58. The increase in negative pressure causes the stem 52 to be unlatched so that the pivot point for the lever 28 is no longer fixed. Once this occurs, the main valve will automatically close to shut off further flow of fuel through the nozzle.

Figure 4:
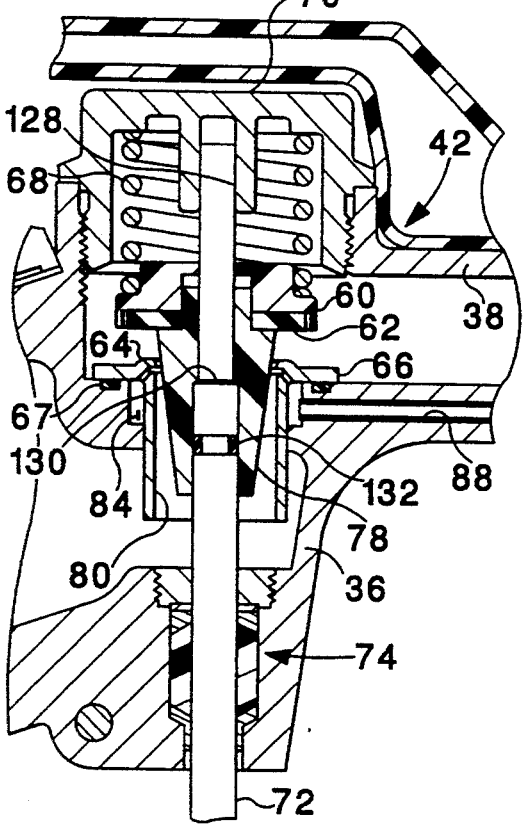
FIG. 4 is a longitudinal section, on an enlarged scale, of a main shut off valve seen in FIG. 2.

More specifically, the construction of the valve 42 includes a poppet (FIG. 4) formed by a seal holder 60 and a sealing disc 62 that is sealingly engageable with an annular sealing surface 64 formed on a seat member 66. The main valve poppet is urged to a closed position by a spring 68 that engages the upper surface of the seal holder 60 and a cap 70 that is threaded into the nozzle body 36. An O-ring 67 provides a seal between the seat member 66 mad the nozzle body 36.

A valve stem 72 extends downwardly from the main valve poppet, through a packing 74, in the nozzle body, to engage the upper surface of the operating lever 28. The valve spring 68, through the stem 72, thus exerts a downward force on the lever 28, whenever the lever 28 is pivoted, to raise its free end and open the valve 42. Pivotal movement of the lever 28 to open the valve 42 can only be made when the stem 52 is latched in its elevated position. Likewise, the lever 28 can only be maintained in a position that opens the valve 42 (either manually, or by means of the illustrated latch 76) so long as the stem 52 is latched in its elevated position.

When the negative pressure in chamber 58 increases to unlatch the stem 52, the spring 68 is free to close the valve 42, by moving the main poppet downwardly.

The foregoing description of the nozzle components, particularly with reference to the means for providing the automatic shut off function, are well known in operating principle. The structure described is similar to that which is more fully described in copending patent Ser. No. 986,521, filed Dec. 12, 1993 and is hereby incorporated by reference.

The present invention departs from this known nozzle construction in providing a slurpee function for suctioning liquid fuel from the low point in the vapor passage of the coaxial hose 22 and returning that fuel to the fuel passage 40 in the nozzle 20. More specifically, the present invention involves providing a slurpee venturi 77 at the main control valve 42 for purposes of suctioning liquid fuel from the vapor passage of the hose 22 and, further, in doing so with minimal, if any loss in energy.

Figure 4A:
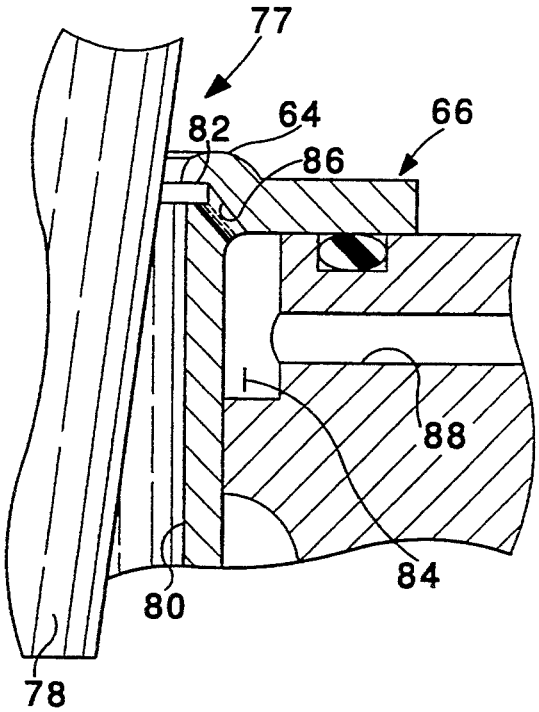
FIG. 4A is a fragmentary view, on a further enlarged scale, of a portion of the valve seen in FIG. 4.

To this end, the main poppet additionally includes a depending conical member 78, which is referenced as a "plug". The plug 78, depends into a cylindrical passageway 80, immediately below the valve seat surface 64. An outwardly extending, circumferential groove 82 (FIG. 4A) is provided at the upper end of the cylindrical passageway 80. The entrance to the venturi is defined by a curved surface that extends from the sealing surface 64 to the upper end of the groove 82. It is to be noted that the diameter of the cylindrical passage 80 is slightly greater than the diameter of the upper end of the groove 82.

The seat member 66 is preferably in the form of an insert having an integral tubular portion forming the cylindrical passage 80 and a radial flange forming the seat 64. The tubular portion of the seat member 66 is inserted into a counterbored hole in the nozzle body 36 that connect an upper inlet portion of the fuel passage 40 with a lower, downstream portion of the fuel passage. This assembly defines an annular suction chamber 84 surrounding the cylindrical passage 80. The groove 82 is connected with the suction chamber 84 by a plurality of circumferentially spaced holes 86.

Figures 2, 3:
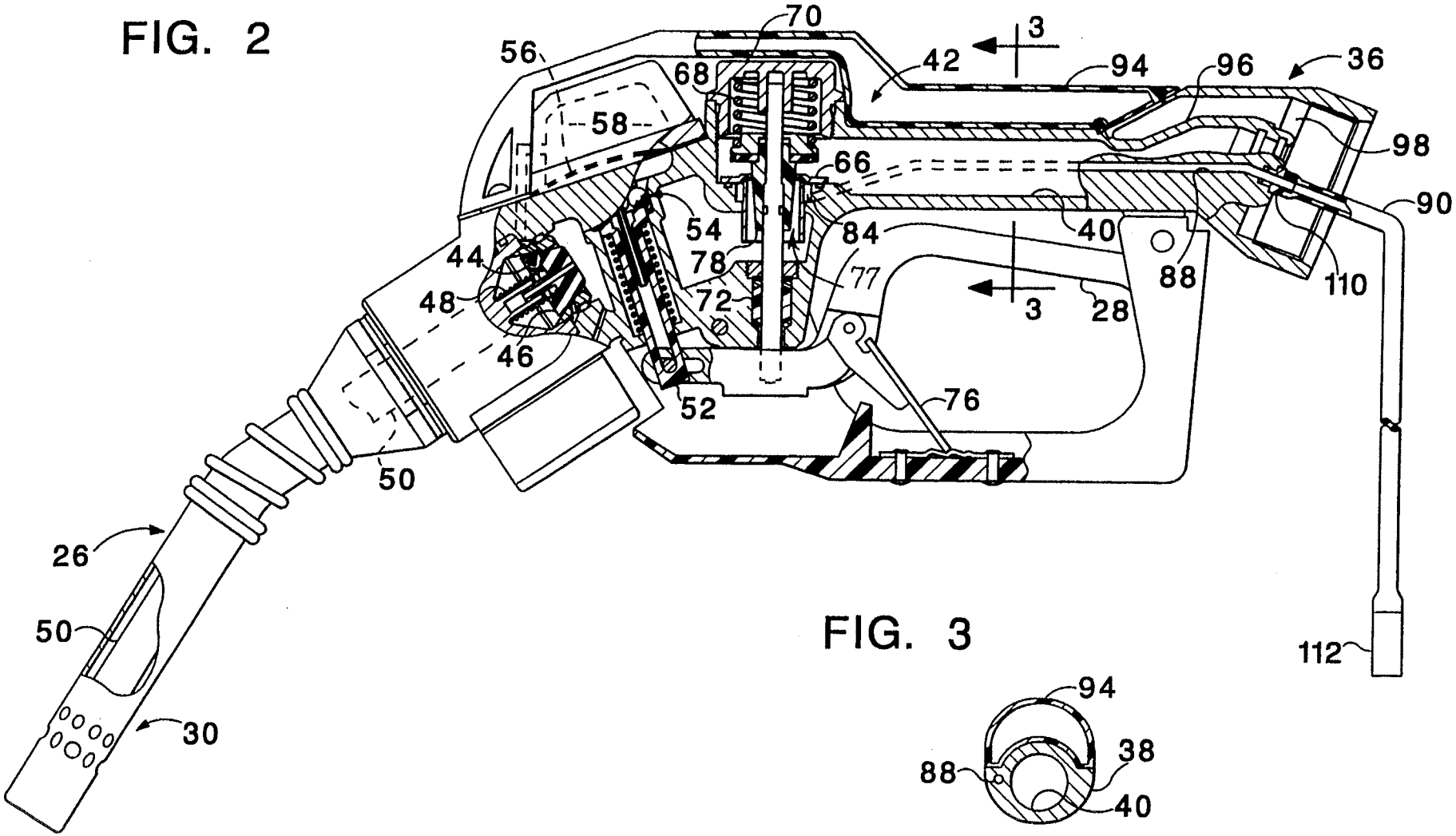
FIG. 2 is an enlarged elevation of the nozzle seen in FIG. 1, with portions broken away and in section.
FIG. 3 is a section taken on line 3—3 in FIG. 2.
Figure 7:
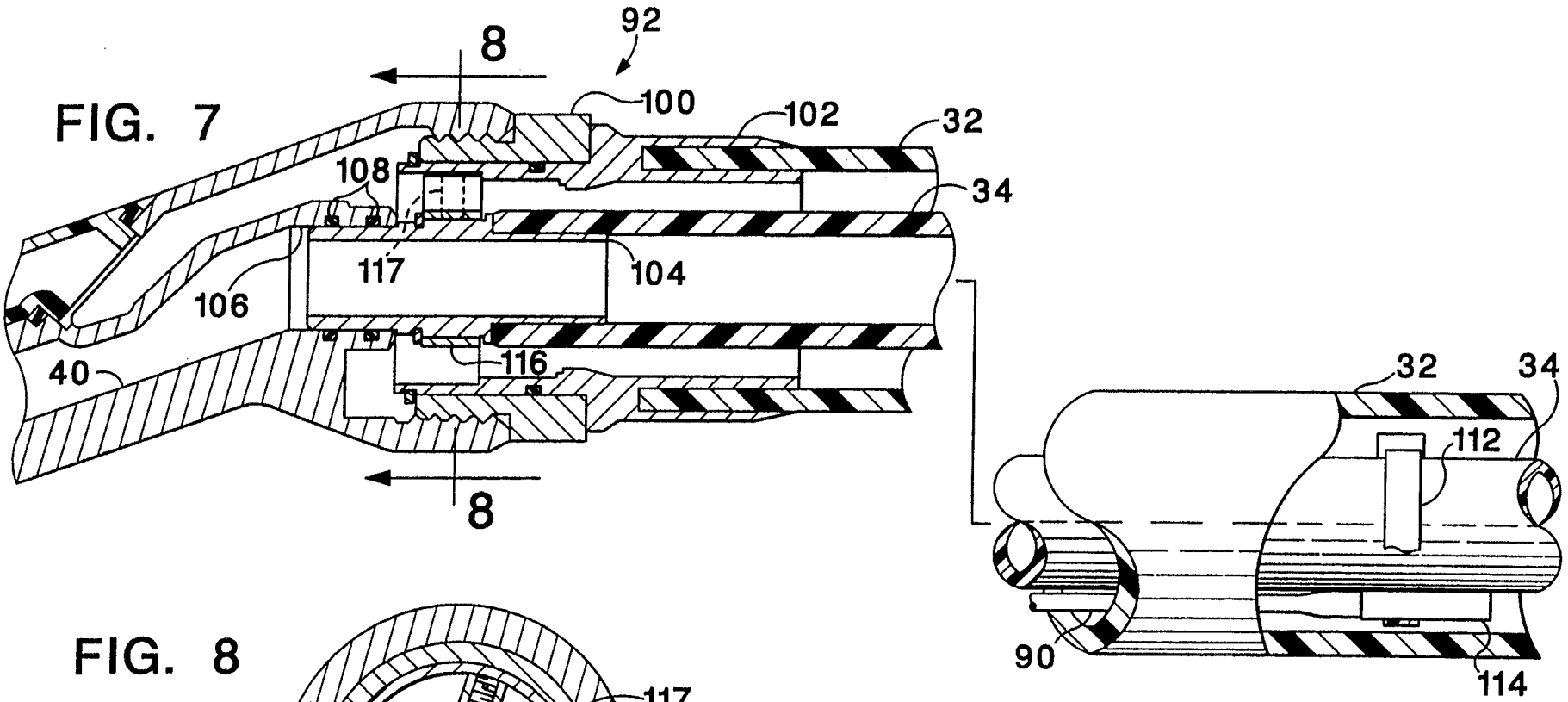
FIG. 7 is a view, on an enlarged scale and in longitudinal section, illustrating the connection between the fuel nozzle seen in FIG. 2 and a coaxial hose in which a slurpee suction tube is disposed.
Figure 9:
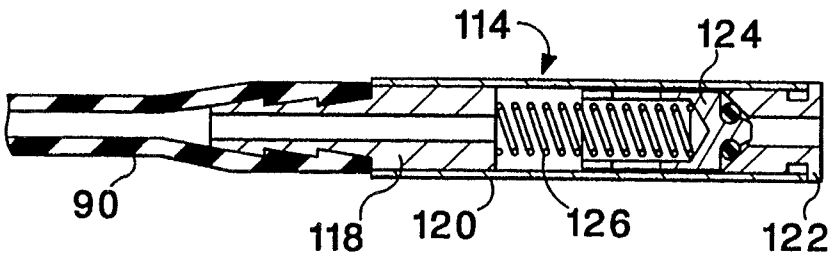
FIG. 9 is a longitudinal section, on an enlarged scale of the terminal end of the slurpee suction robe seen in FIG. 7.
Figure 8:
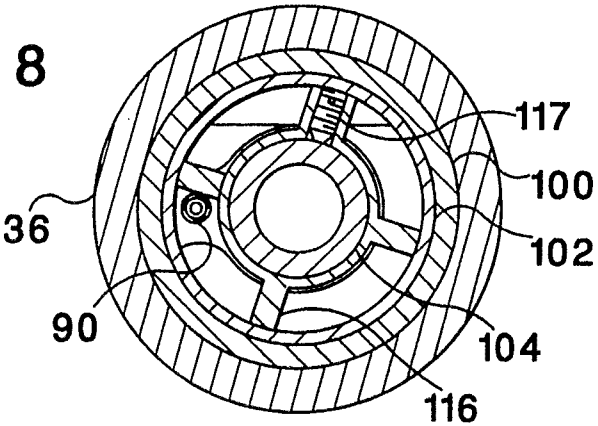
FIG. 8 is a section taken on line 8—8 in FIG. 7.

A suction passage 88 extends from the chamber 84, through the hand grip portion 38 for connection with a suction tube 90. This connection is best shown in FIGS. 2, 7 and 8, which also illustrate the mariner in which the coaxial hose is connected to the nozzle body 36. The latter feature will next be described.

As a preliminary to this description it will be noted that the major portion of the vapor return passage along the length of the nozzle body is through a removably mounted vapor cap 94, FIGS. 2 and 3 (reference said application Ser. No. 986,521 for a further description of a vapor cap). The vapor cap passage communicates with a vapor passage 96 that expands to an annular, outwardly facing opening 98 at the right hand end of the nozzle body 36. A cylindrical, outwardly facing outlet for the fuel passage 40 is provided concentrically of the annular opening 98, thereby forming an adapter for connection with a connector 92, mounted on the coaxial hose 22.

The hose connector 92 comprises a nut 100 that is threaded into the annular vapor passage 98. The outer hose is sealingly captured in an annular socket in a tubular fitting 102 that is rotatably and sealingly received in the nut 100. A removable snap ring prevents the fitting 102 from being pulled out of the nut 100. The inner hose 34 is telescoped over a fitting 104, which is inserted into a bore 106 at the entrance end of the nozzle fuel passage 40, with O-rings 108 providing a seal therewith.

Reverting back to the suction passage 88, this passage extends from the bottom of the hand grip portion 38 (FIGS. 3 and 4) to one side thereof and then to the end of the nozzle (FIG. 8) to which the coaxial hose 22 is connected. A fitting 110 is provided, as an extension of the suction passage 88. The tube 90 is then yieldingly expanded in being mounted on the fitting 110, to thereby effect a sealed connection therewith.

The suction tube 90 extends to the low point of the coaxial hose 22 (FIG. 1) and has a check valve 112. Preferably, the check valve is secured to the inner hose 34 before being assembled inside the hose 32, as by the illustrated band clamp 114. The tube 90 has a sufficient length for it to be secured to the fitting 110 either before or after the inner hose fitting is inserted into the bore 106. In positioning the fitting 104 in the bore 106, it is rotated so that the terminal end of the hose 90, as defined by the check valve 114, is disposed at the bottom of the tube. It is preferable to secure a spider 116 to the fitting 104. The spider 116 is secured on the fitting 104 by a set screw 117 and is engaged by a shoulder on the outer fitting 102 to assure that the fitting 104 is seated in the bore 106. The spider legs also are engageable with the fitting 110/tube 90 to prevent rotation of the inner hose 34 relative to nozzle body 36, thereby assuring that the inlet (check valve 114) to the hose 90 will be disposed substantially at the bottom of the inner hose 34.

The check valve 114 comprises a tubular housing 116 having a stem portion over which the robe 90 is expanded to connect the hose 90 to the valve 114. A sleeve 120 projects beyond the housing 118 and has a valve seat 122 at its outer end. A valve piston 124 is urged into sealing engagement with the valve seat 122 by a spring 126.

When the main control valve 42 is opened, there is an annular flow of fuel through the venturi valve passage 77 defined by valve seat member 66 (passage 80) and the plug 78. This passage rapidly narrows to a minimum flow area (throat) at the upper end of the circumferential groove 82 and then gradually expands as the area between the plug 78 and the cylindrical passage 80 increases. Preferably the angle between the plug 78 and cylindrical surface 80 is no greater that approximately 10°.

With the described configuration of the venturi passage a maximum suction (negative pressure) is generated in the groove 82, with a minimum of energy losses. It is to be noted that the magnitude of the negative, venturi pressure is proportional to the extent to which valve 42 is opened and the rate of fuel flow. This negative pressure is communicated through the holes 86, to the chamber 84, then to the suction passage 88 and the suction tube 90.

The piston valve 124 will not open until the force of the spring 126 is overcome. This is to point out that the slurpee function is not provided at low flow rates, where the negative pressure is insufficient to cause the piston valve to open against the force of spring 126. It is also to be remembered that the vapor return passage between the hoses 32, 34 is also at a negative pressure. Thus to open the valve 114, it is necessary that the negative pressure force on the piston 124 (from the tube 90) be greater than the negative pressure force from the vapor return passage, plus the closing force of the spring 126.

With these factors in mind, it is possible to set the spring force so that the check valve 114 remains closed, unless there is liquid fuel in the low point of the vapor return hose or the rate of fuel flow through the nozzle is at a point where losses in efficiency do not have an adverse affect on the delivery, rate. More specifically, with this arrangement, there is little or no in, pact on the ability, of the shut off venturi 44 to generate a negative pressure sufficient to actuate the automatic shut-off function at low flow rates.

In most cases, the user of the nozzle, will, at least initially, open the control valve 42 to its maximum extent so that it is assured, for a substantial portion of the time fuel is being delivered, that there will be a sufficient negative pressure generated in the slurpee venturi 77 to draw liquid fuel from the low point of the vapor return passage in the coaxial hose 22. Actually the fuel is drawn through the suction tube 90, into the nozzle body passage 88 and chamber 84. From the chamber 84, the fuel is drawn through the holes 86 and back into the fuel that is to be discharged from the nozzle.

The efficiency and effectiveness of providing a suction source for the slurpee function is enhanced by maintaining a concentric relation between outer bounds of the venturi passageway, defined by the seat member 66 and the inner bounds of the venturi passageway defined by the plug 78.

To this end it should first be noted that the nozzle body bore through which the valve stem 72 extends, the counterbore which receives the valve seat member 66 and the threaded opening which receives the spring cap 70 are coaxial and are readily formed on a common axis, as by a single machining set up for the nozzle body, whereby the identified surfaces are concentric. It is to be further noted that the valve stem 72 extends upwardly, through the venturi plug 78 and the seal holder 62 and is then slidingly received in a bore 128 in the spring cap 70. The plug 78 is provided with a counterbore that is engaged by a shoulder 130 on the stem 72 so that upward movement of the stem 72, by pivoting of the lever 28, will cause the valve 42 to open, against the action of spring 86. An O-ring 132 provides a liquid seal between the stem 72 and plug 78 to prevent leakage when the valve 42 is closed.

With the described construction, the plug 78 is accurately and stably positioned relative to the seat member 66 in all positions of the stem 72, as it is raised to a fully open position.

Figure 5:
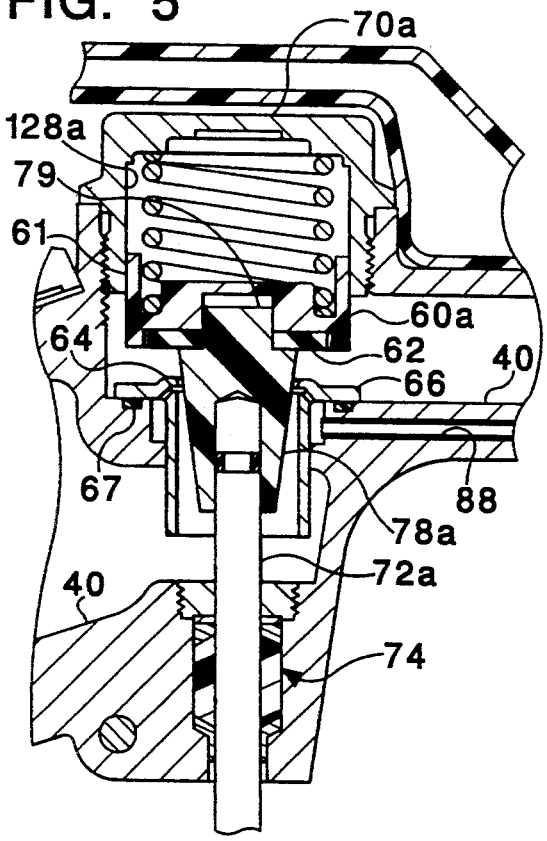
FIG. 5 is a longitudinal section, on an enlarged scale, of an alternate construction of the main shut off valve seen in FIG. 2.

FIG. 5 illustrates an alternate construction for providing an accurate and stable, concentric relationship between the inner and outer bounds of the venturi passageway, when the valve 42 is in an open position.

In this embodiment the positioning of the seal member 66 and the lower end of a modified stem 72*a* is as in the previous embodiment.

The stem 72*a* extends upwardly into a blind hole in the lower portion of a modified plug 78*a*. The plug 78*a* has an upwardly projecting, central post 79 that is received by and centrally positioned relative to a modified seal holder 60*a*. The seal holder 60*a* has a concentric, upstanding skirt 61 that is slidingly received and guided by a concentric bore 128*a*, formed in a modified spring cap 70*a*.

The net affect of this alternate construction is to provide a stable guide for the upper end of the plug 78*a* so that it is stably maintained in concentric relation with the seal member 66 as the valve 42 is displaced from a closed position to a fully open position.

Figure 6:
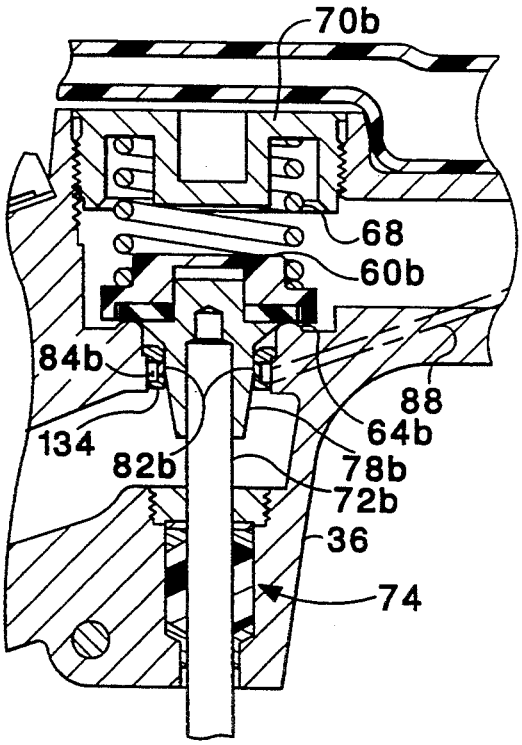
FIG. 6 is a longitudinal section, on an enlarged scale, of another alternate construction of the main shut off valve seen in FIG. 2.

FIG. 6 illustrates a further embodiment of the invention, in which there has been a minimum modification of an existing main shut-off valve design in providing the slurpee function.

The spring cap 70*b*, seal holder 60*b* and stem 72*b* may be essential the same as, if not identical with, existing valve components. Similarly, the valve seat 64*b* is formed integrally with the nozzle body 36.

A plug member 78*b* rests, in conventional fashion on the stem 72*b* and is thereby centralized with respect to the valve flow passage. A venturi ring 134 is mounted in the vertical valve flow passage, beneath the seat 64*b* and defines the outer bounds of a venturi throat. The inner bounds of the venturi throat are defined by the plug 78*b*, when the valve 42 is open. It will be noted that, at least during initial portions of upward opening movement of the valve stem 72*b*, flow of liquid is metered, i.e., controlled by the venturi throat defined by the ring 134 and plug 78*b*.

The ring 134 defines an annular chamber 84*b*, which communicates with the venturi throat through a series of radially extending holes 82*b*. The chamber 84*b* communicates with a slurpee suction passage 88, as in the previous embodiments.

When the stem 72*b* is elevated to open the main valve 42, fuel flow through the main poppet venturi creates a suction in the passage 88 and the attached tube 90 to draw condensate from the hose vapor passage and return it to the fuel being discharged by the nozzle, all as was previously described.

It is to be understood and anticipated that variations from the described embodiments will occur to those skilled in the art within the spirit and scope of the present inventive concepts as are set forth in the following claims.

Having thus described the invention, what is claimed as novel and desired to be secured by Letters Patent of the United States is:

1. A fuel dispensing nozzle comprising
a fuel &livery passage extending from a hand grip portion to a spout from which fuel is discharged into a container,
a main valve for controlling the flow of fuel through said delivery passage,
automatic shut-off means, responsive to a vacuum generated by flow of fuel through a shut-off venturi downstream of the main valve, for causing the main valve to close when the level of fuel in the container rises to a given level,
a vapor return passage extending from the spout to said hand grip portion,
said fuel dispensing nozzle being adapted for connection to hose means including fuel and vapor passages,
said nozzle being adapted to provide a slurpee function of evacuating liquid fuel from the vapor passage of the hose means, and further including
a slurpee, vacuum passage adapted for connection to a tube that extends from the nozzle, to an intermediate, low point along the length of the vapor passage of the hose means,
said nozzle being characterized by
a slurpee, venturi passage at the main valve, and
means for connecting the slurpee, venturi passage to the slurpee, vacuum passage,
whereby liquid will be evacuated from the vapor passage of the hose means and returned to the fuel delivery passage of the nozzle by way of the slurpee, venturi passage at the main valve.

2. A fuel dispensing nozzle as in claim 1 wherein
the main valve comprises
an annular valve seat through which the fuel delivery passage passes,
a sealing disc in opposed relation to the valve seat,
a spring urging the disc towards sealing engagement with the valve seat,
a valve stem that is displaceable to move the sealing disc to an open position in spaced relation with valve seat,
further characterized by
a venturi plug, which is centrally disposed of the portion of the fuel passage immediately downstream of the valve seat, the venturi plug defining the inner bounds of the slurpee venturi passage.

3. A fuel dispensing nozzle as in claim 2 further comprising
a nozzle body, mad
wherein
the fuel flow passage through and immediately downstream of the valve seat is generally vertically disposed, and
the valve stem extends through a lower portion of the nozzle body and is generally aligned with the fuel flow passage downstream of the valve seat,
further characterized in that
the lower portion of the venturi plug is positioned by the valve stem, and
further characterized by
means for guiding the upper end of the venturi plug to thereby maintain the venturi plug in a stable, concentric relation with the slurpee venturi passage.

4. A fuel dispensing nozzle as in claim 3 wherein
an upper opening in the nozzle body is provided above the valve seat and aligned with the lower opening in the nozzle body,
a spring cap is threaded in the upper body opening to maintain spring in a position urging the sealing disc into sealing engagement with the valve seat, and
further characterized in that the valve stem extends through the venturi plug and positions both its upper and lower ends, and the upper end of the valve stem is slidingly guided by means extending downwardly from the spring cap.

5. A fuel dispensing nozzle as in claim 3 wherein an upper opening in the nozzle body is provided above the valve seat and aligned with the lower opening in the nozzle body, a spring cap is threaded in the upper body opening to maintain spring in a position urging the sealing disc into sealing engagement with the valve seat, a seal holder receives and positions the sealing disc, the valve stem extends into a blind hole in the venturi plug, mad the upper end of the plug is positioned centrally of the seal holder, and further characterized in that the seal holder has an upstanding skirt, and the spring cap has a bore slidingly receiving and guiding the seal holder skirt.

6. A fuel dispensing nozzle as in claim 3 wherein an upper opening in the nozzle body is provided above the valve seat and aligned with the lower opening in the nozzle body, a spring cap is threaded in the upper body opening to maintain spring in a position urging the sealing disc into sealing engagement with the valve seat, and the upper and lower body openings are formed on a common axis, mad further characterized by a tubular seat member disposed coaxially of said common axis and defining the outer bounds of the slurpee venturi passage, said tubular seat member also having the valve seat formed on its upper end.

7. A fuel dispensing nozzle as in claim 6 further characterized in that the tubular seat member and the plug cooperate to define a venturi throat at the upper end of the tubular seat member, a vacuum chamber surrounds the tubular seat member adjacent its upper end, said slurpee vacuum passage connects with said vacuum chamber, and means placing the vacuum chamber in fluid communication with the venturi throat.

8. A fuel dispensing nozzle as in claim 7 further characterized by a circumferential groove, at the venturi throat, immediately below the upper end of the tubular seat member, the upper side of said circumferential groove being defined by a lip that projects inwardly from the inner diameter of the tubular seat member.

9. A fuel dispensing nozzle as in claim 2 further comprising a nozzle body, and wherein the fuel flow passage through and immediately downstream of the valve seat is generally vertically disposed, and the valve stem extends through a lower portion of the nozzle body and is generally aligned with the fuel flow passage downstream of the valve seat, an upper opening in the nozzle body is provided above the valve seat and aligned with the lower opening in the nozzle body, a spring cap is threaded in the upper body opening to maintain spring in a position urging the sealing disc into sealing engagement with the valve seat, and further characterized in that nozzle includes a vapor cap defining a portion of the vapor return passage, detachably mounted on the nozzle body, in overlying relation to the spring cap.

10. A fuel dispensing nozzle as in claim 2 further comprising a nozzle body, and wherein the fuel flow passage through and immediately downstream of the valve seat is generally vertically disposed, and the valve stem extends through a lower portion of the nozzle body and is generally aligned with the fuel flow passage downstream of the valve seat, characterized by a venturi ring mounted in the fuel flow passage, downstream of the valve seat, defining, in combination with the plug, a venturi throat.

11. A fuel dispensing nozzle comprising a fuel delivery passage extending from a hand grip portion to a spout from which fuel is discharged into a container, a main valve for controlling the flow of fuel through said delivery passage, automatic shut-off means, responsive to a vacuum generated by flow of fuel through a shut-off venturi downstream of the main valve, for causing the main valve to close when the level of fuel in the container rises to a given level, a vapor return passage extending from the spout to said hand grip portion, said fuel dispensing nozzle being adapted for connection to hose means including fuel and vapor passages, said nozzle being adapted to provide a slurpee function of evacuating liquid fuel from the vapor passage of the hose means, and further including a slurpee, vacuum passage adapted for connection to a tube that extends from the nozzle, to an intermediate, low point along the length of the vapor passage of the hose means, said nozzle being characterized by a slurpee, venturi passage upstream of the shut off venturi, and means for connecting the slurpee, venturi passage to the slurpee, vacuum passage, whereby liquid will be evacuated from the vapor passage of the hose means and returned to the fuel delivery passage of the nozzle by way of the slurpee, venturi passage at the main valve.

* * * * *